US007040073B2

(12) United States Patent
Perkins et al.

(10) Patent No.: US 7,040,073 B2
(45) Date of Patent: May 9, 2006

(54) MACHINE FOR INFLATING AND SEALING AIR-FILLED CUSHIONING MATERIALS

(75) Inventors: Andrew Perkins, Berkeley, CA (US); Oliver Reyes, Berkeley, CA (US); William Robinson, Palo Alto, CA (US)

(73) Assignee: Free-Flow Packaging International, Redwood City, CA (US)

( * ) Notice: Subject to any disclaimer, the term of this patent is extended or adjusted under 35 U.S.C. 154(b) by 39 days.

(21) Appl. No.: 10/929,353

(22) Filed: Aug. 30, 2004

(65) Prior Publication Data

US 2006/0042184 A1 Mar. 2, 2006

(51) Int. Cl.
*B65B 31/00* (2006.01)

(52) U.S. Cl. ..... 53/403; 53/79

(58) Field of Classification Search ..... 53/403, 53/432, 79, 512; 156/145, 147; 428/178
See application file for complete search history.

(56) References Cited

U.S. PATENT DOCUMENTS

| | | | | |
|---|---|---|---|---|
| 2,904,100 | A | 9/1959 | Fener | |
| 3,253,122 | A | 5/1966 | Kochmer et al. | |
| 3,359,703 | A | 12/1967 | Quaadgras | |
| 3,389,534 | A | 6/1968 | Pendelton | |
| 3,492,783 | A | 2/1970 | Dohmeier | |
| 3,554,135 | A | 1/1971 | Duvall et al. | |
| 3,575,757 | A * | 4/1971 | Smith | 53/79 |
| 3,660,189 | A | 5/1972 | Troy | |
| 3,667,593 | A | 6/1972 | Pendleton | |
| 3,674,614 | A | 7/1972 | Templeton | |
| 3,703,430 | A | 11/1972 | Rich | |
| 3,769,145 | A | 10/1973 | Gresham et al. | |
| 3,817,803 | A | 6/1974 | Horskey | |
| 3,868,285 | A | 2/1975 | Troy | |
| 3,889,743 | A | 6/1975 | Presnick | |
| 3,938,298 | A | 2/1976 | Luhman et al. | |
| 4,017,351 | A | 4/1977 | Larson et al. | |
| 4,021,283 | A | 5/1977 | Weikert | |
| 4,096,306 | A | 6/1978 | Larson | |
| 4,169,002 | A | 9/1979 | Larson | |
| 4,415,398 | A | 11/1983 | Ottaviano | |

(Continued)

FOREIGN PATENT DOCUMENTS

DE 297 17 551 U1 3/1998

(Continued)

OTHER PUBLICATIONS

Claims from 10/031,111 (PCT/NL01/00351).

(Continued)

*Primary Examiner*—Louis Huynh
(74) *Attorney, Agent, or Firm*—Banner & Witcoff, Ltd.

(57) ABSTRACT

Machine for inflating and sealing a preconfigured cushioning material which includes a rotatively mounted roll support shaft having a fixed end and a free end, a hub mounted on the shaft near the fixed end for engagement with a cylindrical core at the end of a roll of film material, a circumferentially expandable roll gripper at the free end of the shaft for locking engagement with the inner wall of the core, an inflator having a conically tapered tip and a plurality of outlet openings for injecting air into cells of the film material, a nip roller pressing against the roll of film material to limit the flow of air into the cells of the film material on the roll, and sealer for sealing the inlet passageways to retain the air in the cells.

24 Claims, 8 Drawing Sheets

U.S. PATENT DOCUMENTS

| | | | |
|---|---|---|---|
| 4,465,188 | A | 8/1984 | Soroka et al. |
| 4,551,379 | A | 11/1985 | Kerr |
| 4,564,407 | A | 1/1986 | Tsuruta |
| 4,586,319 | A | 5/1986 | Ausnit |
| 4,596,111 | A | 6/1986 | Ambrose |
| 4,680,073 | A | 7/1987 | Brunner et al. |
| 4,793,123 | A | 12/1988 | Pharo |
| 4,847,126 | A | 7/1989 | Yamashiro et al. |
| 4,850,912 | A | 7/1989 | Koyanagi |
| 4,872,558 | A | 10/1989 | Pharo |
| 4,874,093 | A | 10/1989 | Pharo |
| 4,918,904 | A | 4/1990 | Pharo |
| 4,941,754 | A | 7/1990 | Murdock |
| 4,949,530 | A | 8/1990 | Pharo |
| 4,981,006 | A | 1/1991 | Caenazzo et al. |
| 5,009,318 | A | 4/1991 | Lepinoy |
| 5,046,258 | A | 9/1991 | Cahill et al. |
| 5,203,761 | A | 4/1993 | Reichental et al. |
| 5,216,868 | A | 6/1993 | Cooper et al. |
| 5,340,632 | A | 8/1994 | Chappuis |
| 5,402,892 | A | 4/1995 | Jaszai |
| 5,406,770 | A | 4/1995 | Fikacek |
| 5,427,830 | A | 6/1995 | Pharo |
| 5,447,235 | A | 9/1995 | Pharo |
| 5,454,642 | A | 10/1995 | De Luca |
| 5,535,888 | A | 7/1996 | De Luca |
| 5,552,003 | A | 9/1996 | Hoover et al. |
| 5,581,983 | A | 12/1996 | Murakami |
| 5,604,016 | A | 2/1997 | Allegre |
| 5,651,237 | A | 7/1997 | De Luca |
| 5,658,632 | A | 8/1997 | Krabill |
| 5,660,662 | A | 8/1997 | Testone |
| 5,692,833 | A | 12/1997 | DeLuca |
| 5,693,163 | A | 12/1997 | Hoover et al. |
| 5,755,082 | A | 5/1998 | Takahashi et al. |
| 5,755,328 | A | 5/1998 | DeLuca |
| 5,824,392 | A | 10/1998 | Gotoh et al. |
| 5,858,153 | A | 1/1999 | Mack |
| 5,873,215 | A | 2/1999 | Aquarius et al. |
| 5,937,614 | A | 8/1999 | Watkins et al. |
| 5,942,076 | A | 8/1999 | Salerno et al. |
| RE36,501 | E | 1/2000 | Hoover et al. |
| 6,015,047 | A | 1/2000 | Greenland |
| 6,209,286 | B1 * | 4/2001 | Perkins et al. ..... 53/403 |
| 6,272,815 | B1 | 8/2001 | Todd et al. |
| 6,375,785 | B1 | 4/2002 | Aquarius |
| 6,410,119 | B1 | 6/2002 | De Luca et al. |
| 6,423,166 | B1 | 7/2002 | Simhaee |
| 6,460,313 | B1 | 10/2002 | Cooper |
| 6,565,946 | B1 * | 5/2003 | Perkins et al. ..... 428/178 |
| 6,582,800 | B1 | 6/2003 | Fuss et al. |
| 6,598,373 | B1 * | 7/2003 | Sperry et al. ..... 53/403 |
| 6,651,406 | B1 * | 11/2003 | Sperry et al. ..... 53/403 |
| 6,659,150 | B1 | 12/2003 | Perkins et al. |
| 6,761,960 | B1 | 7/2004 | De Luca et al. |
| 6,786,022 | B1 | 9/2004 | Fuss et al. |
| 2003/0118778 | A1 | 6/2003 | Perkins et al. |
| 2003/0163976 | A1 | 9/2003 | Perkins et al. |
| 2004/0206050 | A1 | 10/2004 | Fuss et al. |

FOREIGN PATENT DOCUMENTS

| | | |
|---|---|---|
| DE | 199 13 408 A1 | 10/2000 |
| DE | 199 13 408 C2 | 10/2000 |
| EP | 0836926 A2 | 4/1998 |
| FR | 2389547 | 12/1978 |
| FR | 2580597 | 10/1986 |
| GB | 2218401 A | 11/1989 |
| JP | 7/16961 | 1/1995 |
| JP | 7/165267 | 6/1995 |
| WO | WO 94/07678 | 4/1994 |
| WO | WO 98/40276 | 9/1998 |
| WO | WO 00/43198 | 7/2000 |
| WO | WO 00/43270 | 7/2000 |
| WO | WO 00/53501 | 9/2000 |
| WO | WO 00 64672 | 11/2000 |
| WO | WO 01/85434 A2 | 11/2001 |

OTHER PUBLICATIONS

Fuss and Yampolsky declaration, 09/488,622.

Air-Fil 1200 photographs (no date but prior to application's filing date).

* cited by examiner

MACHINE FOR INFLATING AND SEALING AIR-FILLED CUSHIONING MATERIALS

BACKGROUND OF THE INVENTION

1. Field of Invention

This invention pertains generally to packing materials and, more particularly, to a machine for inflating and sealing preconfigured film materials to make an air-filled cushioning material which can be wrapped about an object to protect it in shipment and in storage.

2. Related Art

In recent years, air-filled packing materials have come into wide use as a cushioning material or void filler in shipping cartons and the like. The earliest such material to find wide acceptance was probably the material commonly known as bubble wrap which comes in the form of plastic sheets sealed together to form a number of relatively small, individual air-filled cells. Those materials are usually stored and shipped in an inflated state, which is not efficient.

More recently, air filled packing and cushioning materials have been provided in an uninflated, but preconfigured form which can be inflated and sealed at the location or site where they are to be used. Such materials are relatively compact and are typically formed into rolls or stacked into boxes for shipment and storage. They come in a variety of different forms, including relatively large, individual cushions and sheets having rows of smaller, interconnected cells. The communication between the cells in a row is advantageous in that it permits the air to shift from between cells to absorb impact loads as well as permitting the material to conform more closely to the contour of objects wrapped in it. Examples of such materials are found in U.S. Pat. Nos. 6,410,119 and 6,761,960. Heretofore, the width of such materials and the rate at which they can be inflated have been limited to some extent by difficulties in getting the air to flow to the chambers or cells located more remotely from the inflation point.

OBJECTS AND SUMMARY OF THE INVENTION

It is, in general, an object of the invention to provide a new and improved machine for making inflating and sealing air-filled cushioning materials.

Another object of the invention is to provide a machine of the above character which overcomes the limitations and disadvantages of machines heretofore provided.

These and other objects are achieved in accordance with the invention by providing a machine for inflating and sealing a preconfigured cushioning material which is wound in a roll on a hollow cylindrical core and has superposed layers of plastic film sealed together to form rows of interconnected, inflatable cells, a longitudinally extending inflation channel near one edge of the material and inlet passageways interconnecting the inflation channel and the rows of cells, which includes a rotatively mounted roll support shaft having a fixed end and a free end, a hub mounted on the shaft near the free end for engagement with the core at the end of the roll near the inflation channel, a circumferentially expandable roll gripper at the free end of the shaft for locking engagement with the inner wall of the cylindrical core, means for drawing the material from the roll and feeding it along a predetermined path, an inflator having a conically tapered tip and a plurality of outlet openings adapted to be received in the inflation channel for injecting air into the cells as the material travels along the path, a nip roller, means for pressing the nip roller against the roll of film material to block the inflation channel and thereby limit the flow of air into the material on the roll, and means for sealing the inlet passageways to retain the air in the cells.

DETAILED DESCRIPTION

Figure 1:
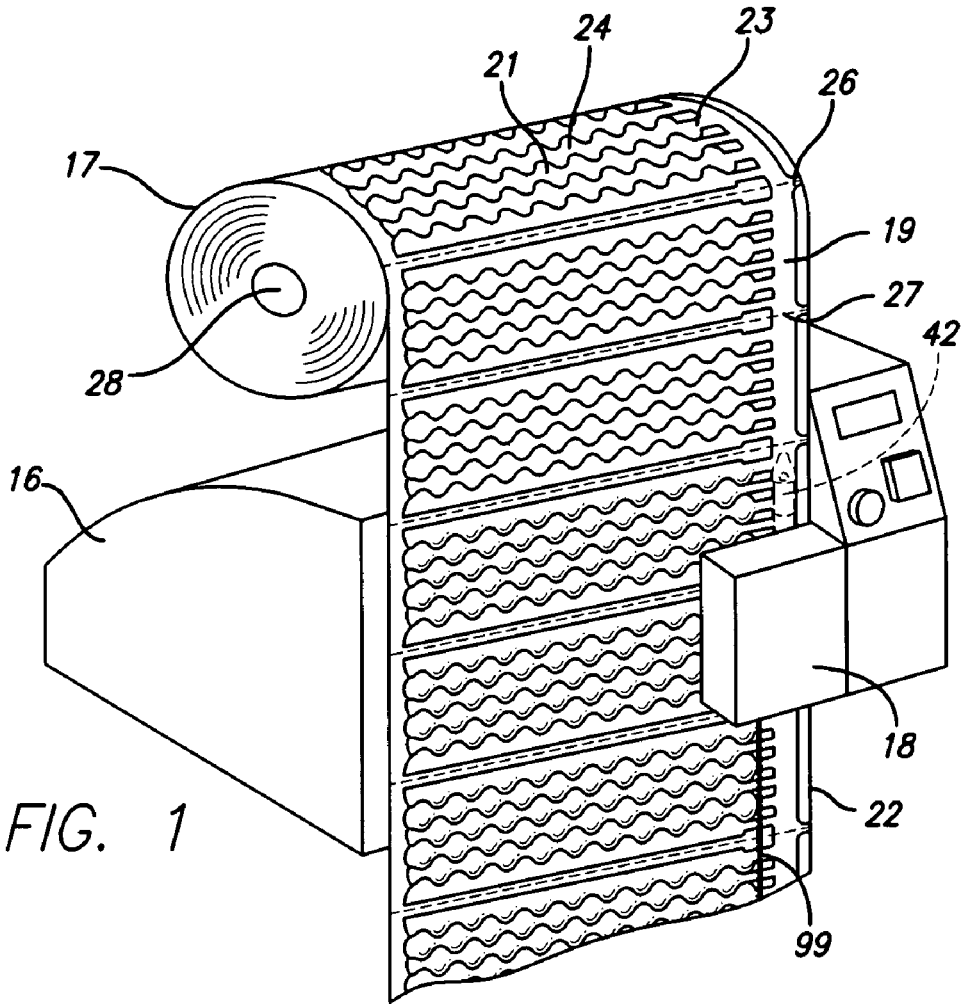
FIG. 1 is a left, front isometric view of one embodiment of a machine for inflating and sealing air-filled cushioning materials in accordance with the invention.

As illustrated in FIG. 1, the machine includes a cabinet 16 which is adapted to rest upon a table top other suitable supporting surface. A supply roll 17 of preconfigured film material is mounted above the cabinet in a manner described hereinafter in detail, and material is drawn from the roll and fed through the machine by a drive mechanism located behind a protective cover 18 on the front side of the cabinet.

The film material has two layers of a suitable plastic material such as polyethylene which are sealed together to form an inflation channel 19 and rows of interconnected, inflatable cells 21. The inflation channel extends longitudinally near one edge 22 of the material, and the rows of inflatable cells extend across the material in a direction generally perpendicular to the inflation channel. Inlet passageways 23 interconnect the inflation channel and the first cell in each of the rows, and passageways 24 interconnect adjacent cells within the rows. Outlet openings 26 extend between the inflation channel and the edge 22 of the material. The rows of cells are formed by undulating seal lines which are offset from each other such that the flow passageways in one row are adjacent to the cells in the rows on either side of it. This material is generally similar to the material shown in U.S. Pat. No. 6,761,960, but substantially wider. In one present embodiment, for example, the material is approximately 30 inches wide and has about 14 cells in each of the rows.

The rows of cells are arranged in groups, and rows of perforations 27 extend laterally or transversely across the material between the groups so that the material can be torn into desired lengths. The cells at the ends of each group are truncated in that the seals along their outer edges are straight, with the perforations being disposed between the straight seals in adjacent groups. In the embodiment illustrated, there are four full rows and two truncated rows in each group, but a greater or lesser number of rows can be included, if desired.

In the embodiment illustrated, the film material is in the form of an elongated tube which has been flattened, with the longitudinally extending edges of the material being closed. However, since the cells, inflation channel and passageways are fully defined by the seals, the material can be a C-folded material having one closed edge and one open edge, or it can consist of two separate sheets which are open along both edges.

The roll of film material is wound on a hollow cylindrical core 28 which is fabricated of a rigid or relatively rigid material such as cardboard.

Figure 3:
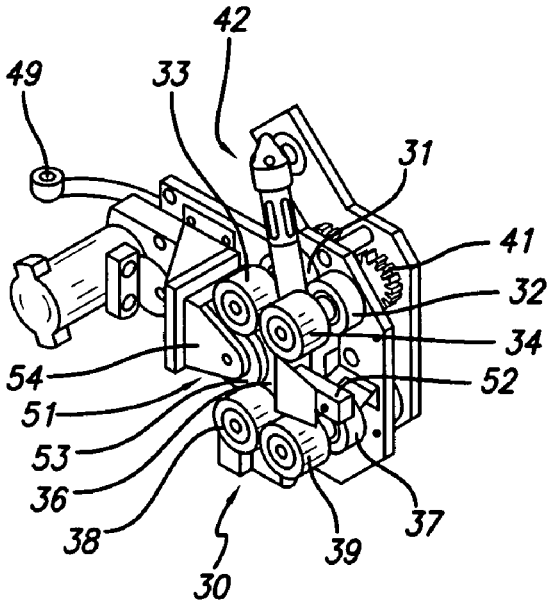
FIG. 3 is an isometric view of the inflation and sealing mechanism in the embodiment of FIG. 1.
Figure 2:
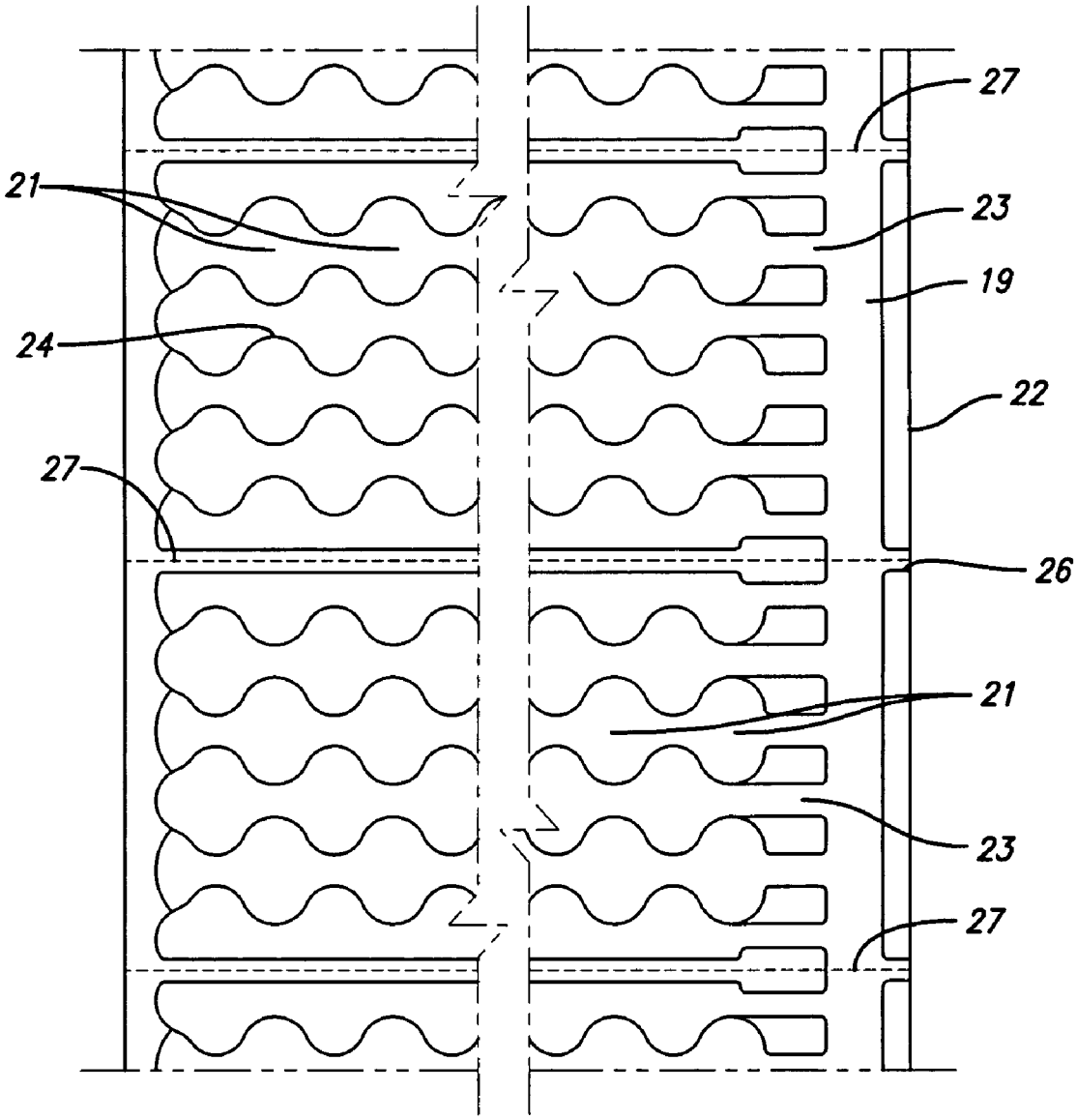
FIG. 2 is a plan view of the preconfigured film material which is inflated and sealed by the machine in the embodiment of FIG. 1.
Figure 4:
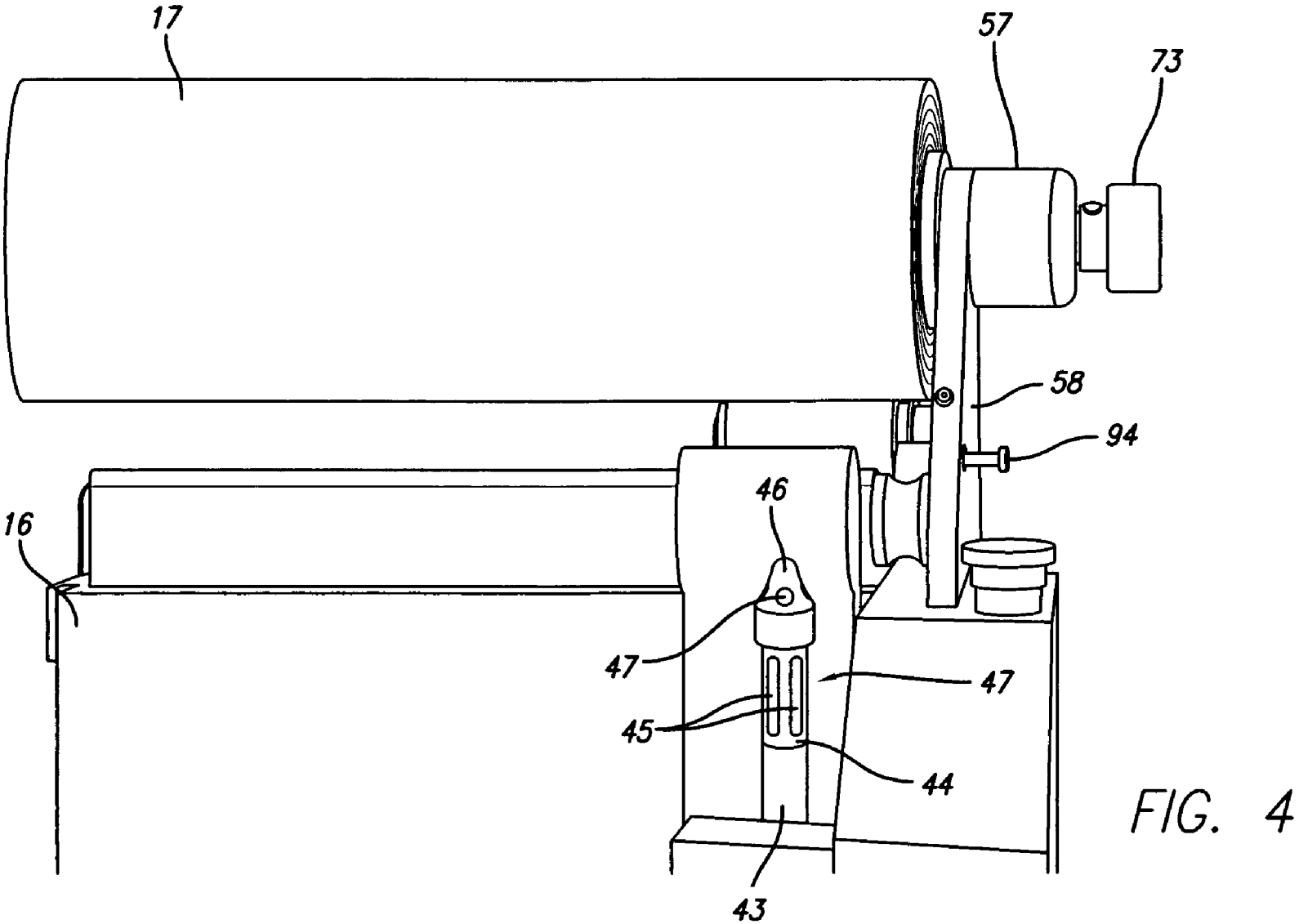
FIG. 4 is a right, front isometric view of the embodiment of FIG. 1 with the material disengaged from the filling and sealing mechanism.
Figure 5:
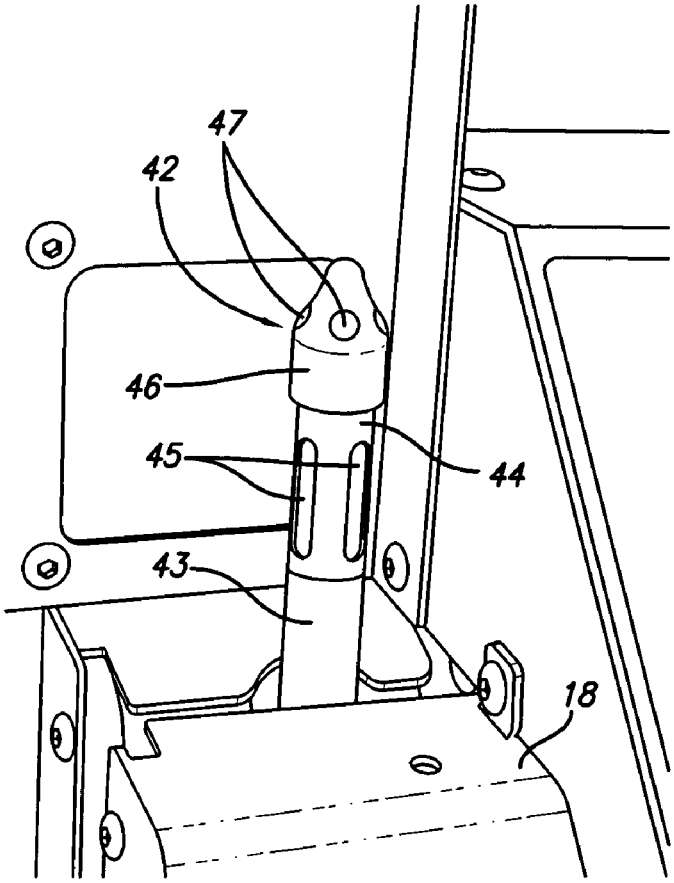
FIG. 5 is a fragmentary isometric view showing the air injector in the embodiment of FIG. 1.

As illustrated in FIG. 3, the drive mechanism 30 includes input rollers 31–34 and output rollers 36–39 which engage the edge portion of the film material and feed it through the machine. The input and output rollers are arranged in dual sets for engaging the film material on opposite sides of the inflation channel. Thus, input rollers 31, 32 and output rollers 36, 37 engage the film material between the inflation channel and the edge of the material, whereas input rollers 33, 34 and output rollers 38, 39 engage it between the channel and the cells.

The feed rollers are driven by a motor (not shown) which is mounted inside the cabinet, with a drive gear on the motor shaft driving gears 41 which are affixed to the shafts on which the rollers are mounted. The gearing is such that the output rollers rotate slightly faster than the input rollers (e.g., an 8:7 ratio) in order to tension the film material and pull it flat as it passes through the sealing assembly to ensure that the film is sealed with no wrinkles on the surface.

Figure 6:
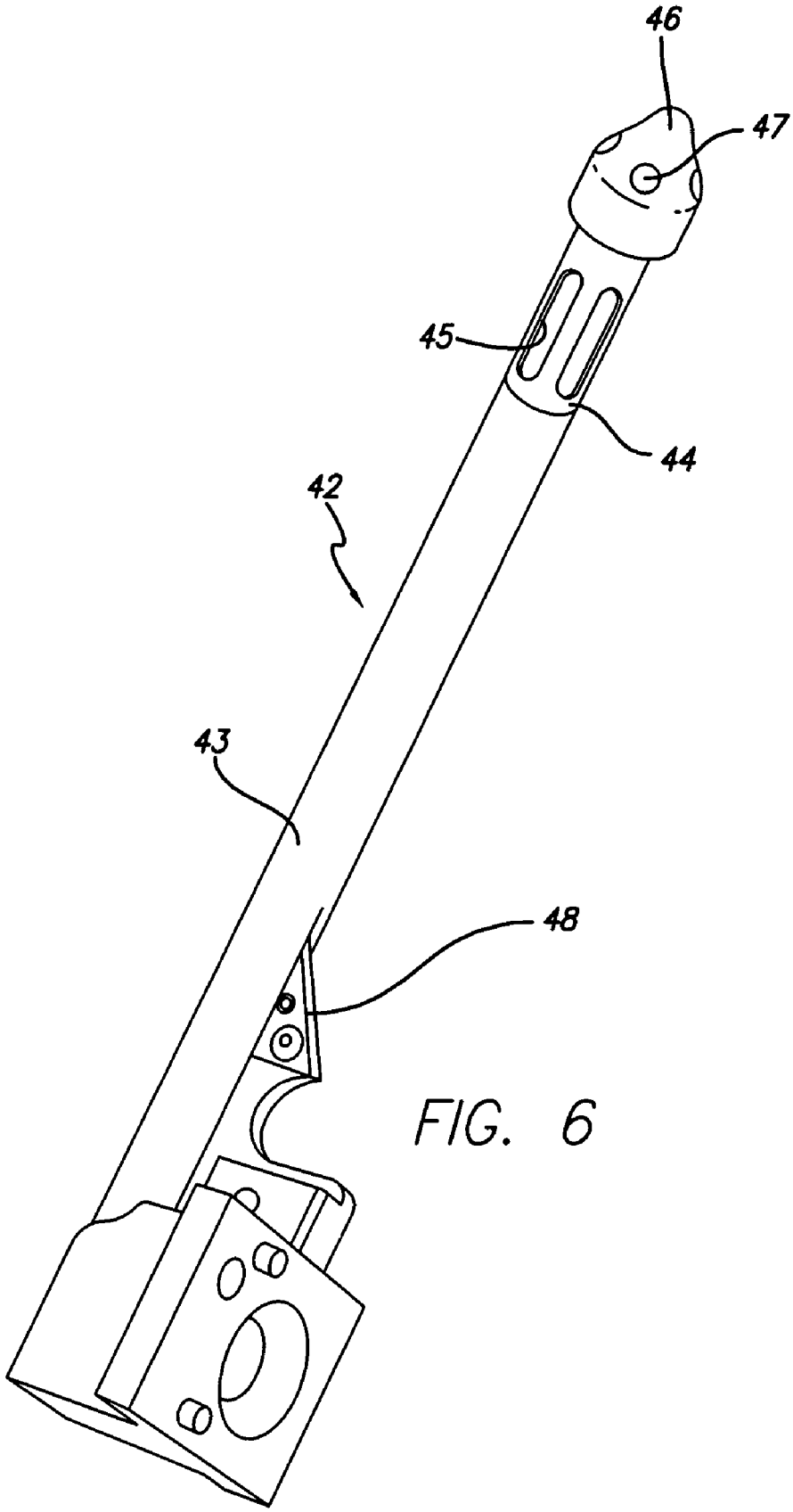
FIG. 6 is an isometric view of the air injector and knife blade assembly in the embodiment of FIG. 1.
Figure 7:
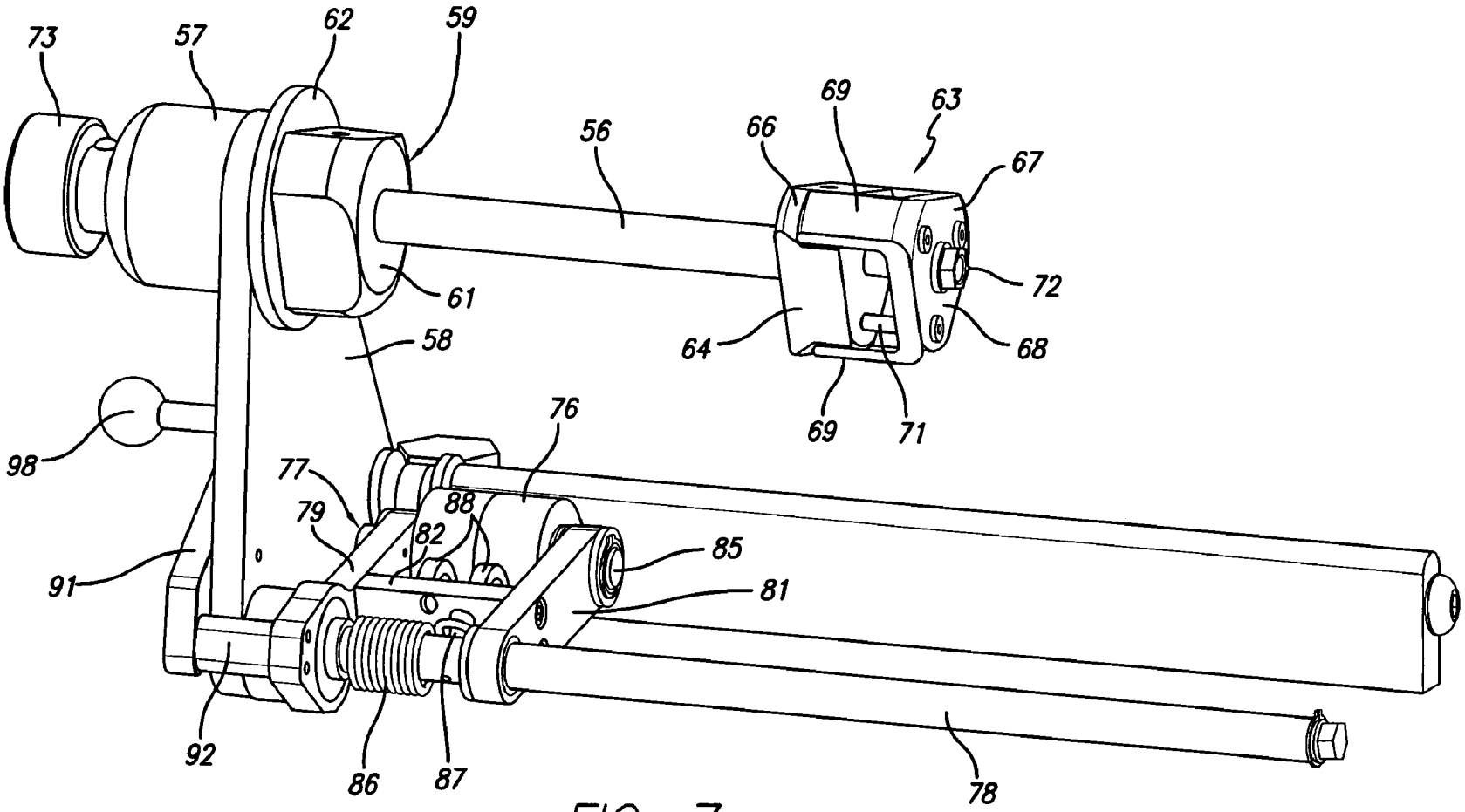
FIG. 7 is a rear isometric view of the shaft for supporting the roll of film material in the embodiment of FIG. 1, with the nip roller in a retracted position.
Figure 8:
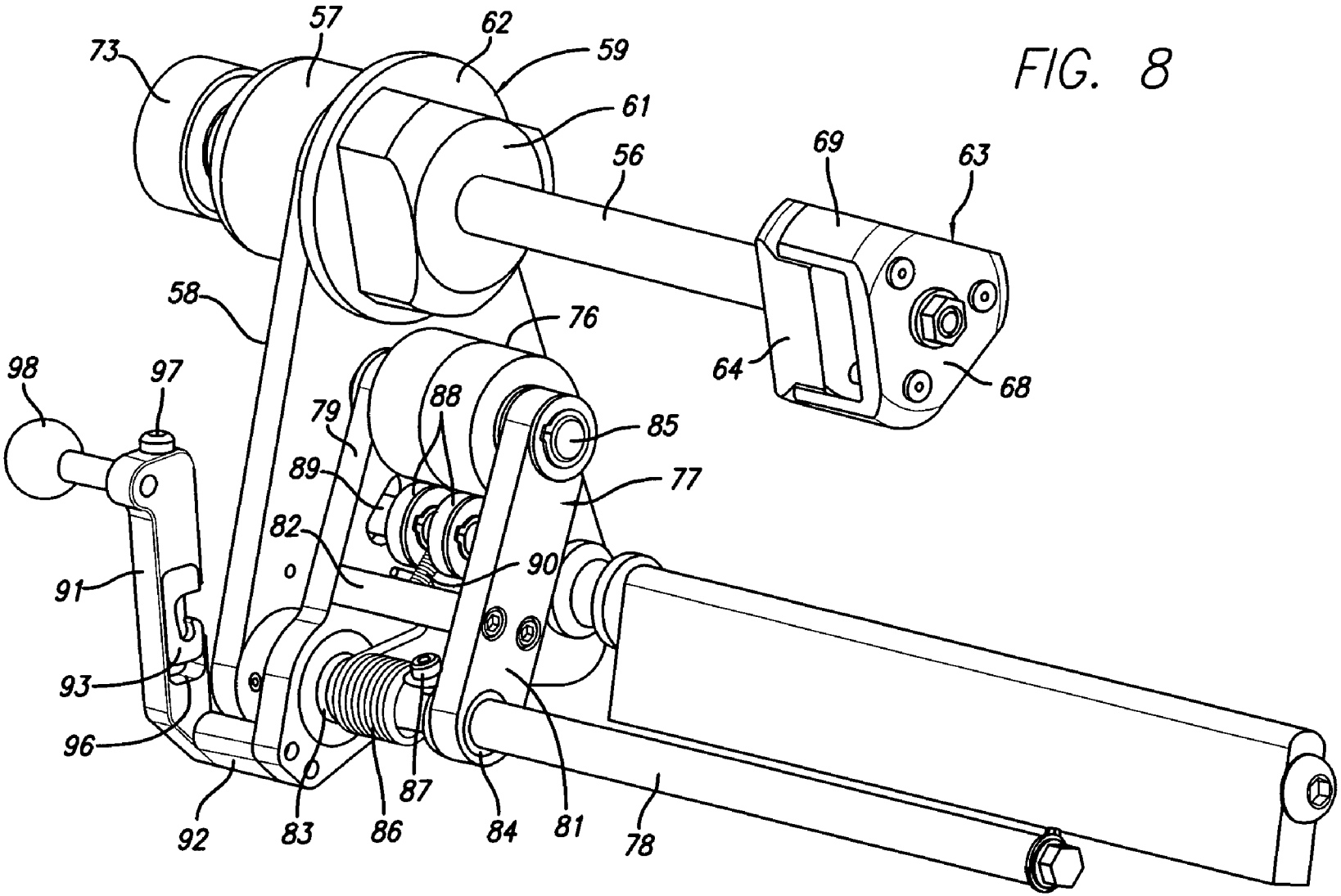
FIG. 8 is a view similar to FIG. 7, with the nip roller in an advanced position for engagement with the roll of film material.
Figure 9:
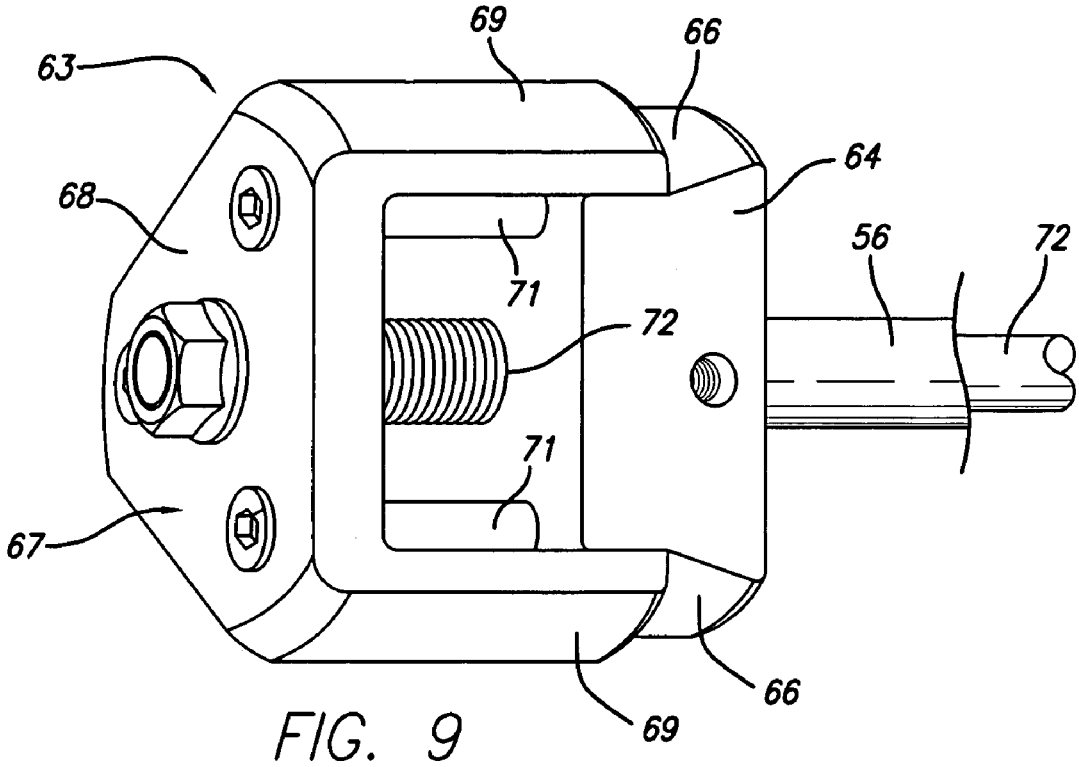
FIGS. 9 and 10 are isometric views showing the roll gripper in the embodiment of FIG. 1 in its retracted and expanded positions.
Figure 10:
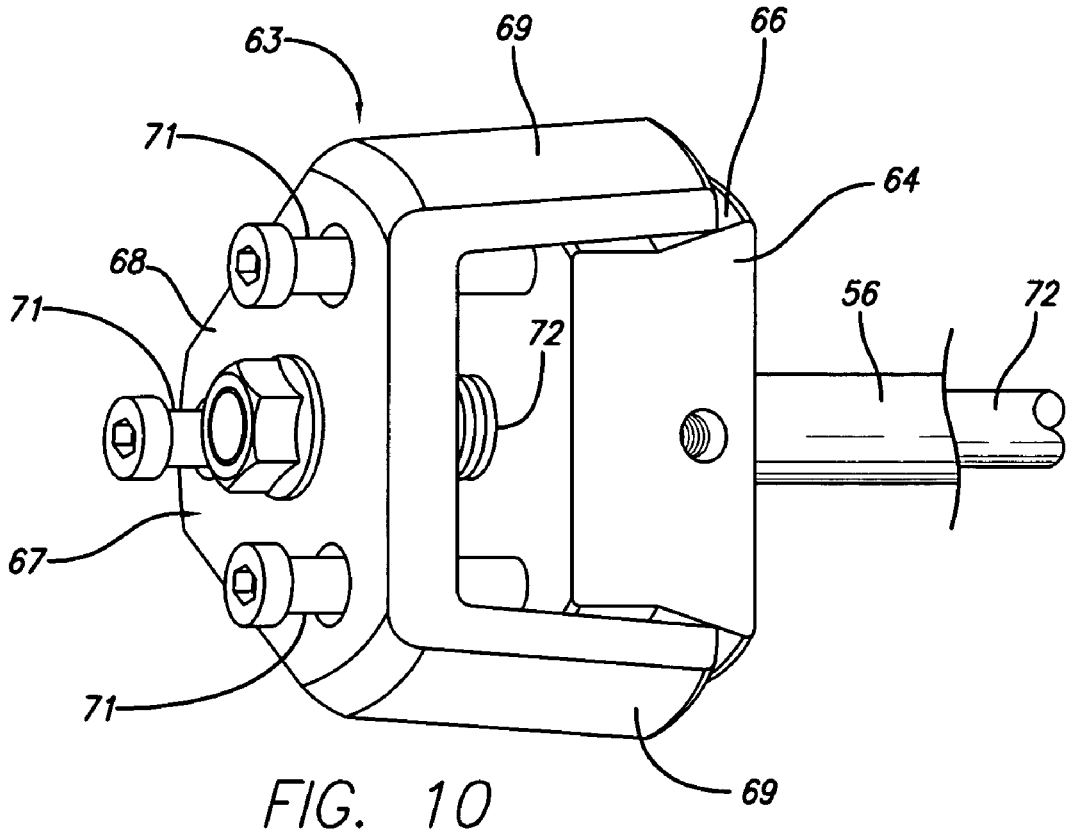

An inflator 42 is positioned between the inner and outer feed rollers and extends in an upward direction for insertion into the inflation channel of the film material. The inflator has a tubular base 43, a tubular upper section 44 with longitudinally extending slotted openings 45 in the side wall thereof, and a conically tapered tip 46 with axially inclined passageways or bores 47. The tip is fabricated of a material such as Teflon and is threadedly attached to the upper portion of the tube. As best seen in FIG. 6, a knife blade 48 is mounted on the base of the inflator for slitting the film along the inflation channel so that the material can separate from the inflator when the cells are inflated.

Air is supplied to the inflator at a pressure on the order of 0.5 to 10 psig by an air pump (not shown) mounted inside the cabinet through an air line and fitting 49 connected to the inlet end of the inflator. The air is discharged into the inflation channel and the cells through slotted openings 45 and passageways 47. If desired, a regulator can be connected between the pump and the inflator to allow users to adjust the air pressure and, hence, the degree of firmness to which the cells are inflated.

A sealing assembly 51 is positioned between the input and output rollers and includes a heating element 52 and a roller 53 which presses the film material against the heating element. The heating element is mounted in a stationary position, and the roller is mounted on a carriage 54. The roller is pressed against the heating element by a cam when the machine is operating, and withdrawn from the heating element by springs when the machine is idle.

A drive mechanism and sealing assembly of this general type are described in greater detail in copending application Ser. No. 10/087,897, the disclosure of which is incorporated by reference.

The roll of film material is mounted on a shaft 56 which is mounted in cantilevered fashion in a bearing assembly 57 on a support plate 58 at one end of the cabinet. The bearing assembly is mounted on the outer side of the plate, and a hub 59 is affixed to the shaft on the inner side of the plate for engagement with the core at the end of the roll near inflation channel 19. The hub has a tricuspid body 61 which fits snugly within the end portion of the cylindrical core and a radial flange 62 for abutting engagement with the end of the core.

A circumferentially expandable roll gripper 63 is provided at the free end of the shaft for locking engagement with the inner wall of the cylindrical core. The gripper has a body 64 with a plurality of axially inclined surfaces 66 which is affixed to the shaft and a head 67 with a body 68 and a plurality of circumferentially spaced jaws 69 which extend from the base in sliding engagement with the inclined surfaces. The head is slidably mounted on a plurality of pins 71 which extend from the body and is drawn toward and moved away from the body by a lead screw 72 which is threadedly connected to the base of the head. The lead screw extends coaxially within the shaft and projects from the fixed end, with an operating knob 73 affixed to the projecting portion of the screw.

When the screw is turned in one direction, the head is drawn toward the body, with the inclined surfaces of the body driving the jaws in an outward direction into locking engagement with the inner wall of the core. Turning the screw in the other direction moves the head away from the body, thereby retracting the jaws and disengaging them from the core.

A nip roller 76 is mounted on a swing arm 77 for movement into and out of engagement with the material on the supply roll to limit the flow of air from the inflator into the material on the roll and to provide a controlled rolling resistance to rotation of the roll. The roller is fabricated of a soft rubber material which deforms when the roller is pressed against the film material. The swing arm is pivotally mounted on a lay shaft 78 which extends from side plate 58 in a direction generally parallel to roll support shaft 56, with the lay shaft being positioned below and to the rear of the roll support shaft and the nip roller aligned with the inflation channel in the material.

In the embodiment illustrated, the swing arm is an H-shaped device, with side arms 79, 81 and a cross arm 82. The swing arm is journaled for rotation about the lay shaft by bushings 83, 84 in the lower or rear end portions of the side arms, and roller 76 is rotatively mounted on a shaft 85 which extends between the free end portions of the side arms.

The nip roller is urged upwardly toward the roll of film material by a torsion spring 86 which is disposed concentrically of the lay shaft, with one end of the spring being secured to the shaft by a set screw 87 and the other bearing against cross arm 82. Brake rollers 88 are mounted on a floating shaft 89 on the swing arm and are pressed into engagement with the nip roller by a screw 90 which extends between cross arm 82 and shaft 89. The nip roller engages the roll at a point located approximately 60 degrees below the point at which the air is injected into the material.

Means is provided for retracting the nip roller and latching it in a retracted position during installation and removal of the film material. This means includes a crank arm 91 which is connected to the swing arm by a spacer 92, and a latch member 93 carried by the crank arm for engagement with a latch pin 94 on the outer side of plate 58. The latch member is slidably mounted in a recess 96 in the crank arm for movement between latching an unlatched positions, and is urged toward the latching position by a spring (not shown) in the crank arm. The latch member is connected to an operating rod 97 which extends coaxially of the crank arm and projects from the free end of the arm. A handle 98 extends laterally from the free end of the crank arm to facilitate movement of the arm.

Operation and use of the machine is as follows. To install a roll of the preconfigured film material, the nip roller is withdrawn or retracted by pulling handle 98 in a forward and downward direction until latch member 93 engages latch pin 94 and holds the roller in the retracted position. The roll of material is then slid over the free end of support shaft 56, with roll gripper 63 retracted and the end of the roll with inflation channel 19 facing the free end of the shaft. With the roll core seated on hub 59 and abutting against flange 62, the gripper is expanded into locking engagement with the inner wall of the core by turning lead screw 72 to draw head 67 toward body 64, with jaws 69 being driven in an outward direction by inclined surfaces 66.

The free end of the film material is threaded manually onto inflator 42 and into engagement with upper feed rollers 31–34, with the inflator being received in the inflation channel 19 in the material. The latch mechanism is then released by depressing the free end of operating rod to disengage the latch member from the pin, following which spring 86 presses nip roller 76 against the roll.

The air is then applied to the inflator, and while the machine is in a standby mode with the roll sitting idle on the machine, the nip roller prevents air from backfilling into the material on the roll and unwinding it from the roll.

As the film material travels through the machine, air flows freely through the openings 45 and 47 into inflation channel 19 and cells 21, thereby inflating the cells. Nip roller 76 continues to block the inflation channel and thus prevents the air from getting going beyond the outer layer of material on the roll. It also provides a rolling resistance which prevents over-coasting when the machine is started or stopped abruptly. The resistance is provided by deformation of the relatively soft nip roller as it rotates and by the braking action provided by rollers 88 pressing against the nip roller. The amount of resistance can be controlled quite accurately by adjustment of screw 90 to vary the pressure of the brake wheels.

Following inflation, the film material travels through sealing assembly 51 where roller 53 presses the material into direct contact with heating element 52. The two layers of film material are thus fused together along a relatively narrow seal line 79 which extends longitudinally of the film material and across inlet passageways 23 to seal the rows of cells. As the material travels along the inflator, it is slit open by knife blade 48 so that it can separate from the inflator.

Figure 11:
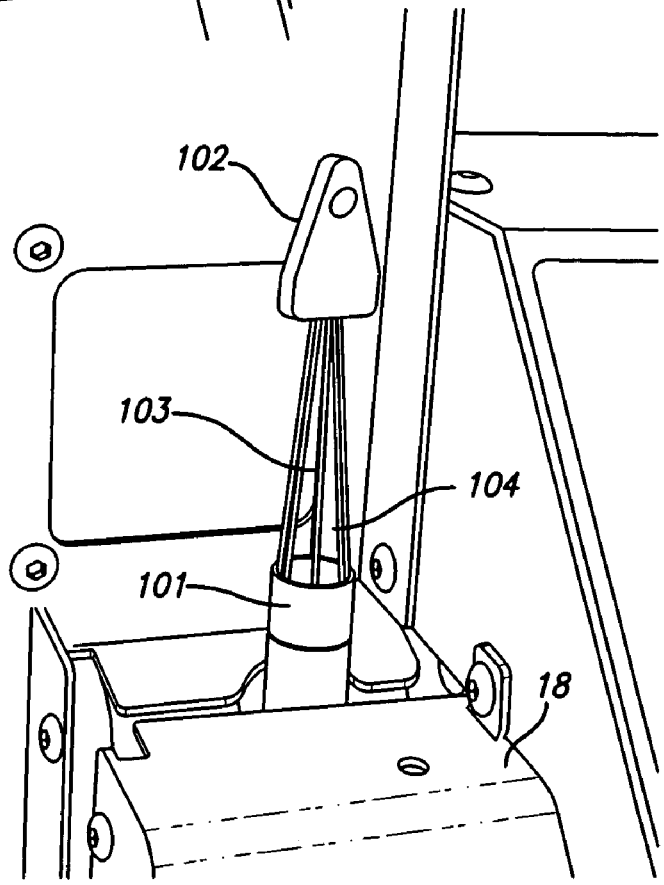
FIG. 11 is a fragmentary isometric view of the embodiment of FIG. 1 with another embodiment of an air injector.

FIG. 11 illustrates another embodiment of an inflator for use in the embodiment of FIG. 1. In this embodiment, the inflator has a tubular base 101 similar to base 43, with a knife blade as shown in FIG. 6. This embodiment differs from the first, however in that it has a triangular or conically tapered tip 102 spaced from the base, and a plurality of circumferentially spaced, wire-like elements 103 which extend between the base and the tip in a radially convergent manner, with openings 104 between the wire-like elements and the tip, the wire-like elements and the base being adapted to be received in the inflation channel as the material passes through the machine.

In the embodiment illustrated, six wire-like elements are spaced 60 degrees apart around the base of the inflator, but any other suitable number and/or spacing can be employed, if desired.

Operation and use of the machine with the inflator of FIG. 11 is similar to that described above except that the air for inflating the rows of cells is discharged into the inflation channel through the openings 104 between the wire-like elements.

The invention has a number of important features and advantages. The roll gripper firmly secures the roll of film material to the supply shaft, and with the gripper engaging the inner wall of the roll core, the machine can accommodate rolls of different widths, ranging from the length of the supply shaft to about twice the length of the shaft. The inflators with the slotted openings, axial bores and wire-like elements deliver a substantially greater flow of air than prior art inflators with a few relatively small lateral openings or a single axial opening, which makes it possible to inflate substantially longer rows of cells and wider sections of material and to do so more uniformly and faster than has heretofore been possible. They also help to maintain the air pressure in the material closer to the sealing mechanism than the inflators employed in prior art machines. If the air were not held under this pressure until just before the material is sealed, the pressure will not be maintained after sealing, and the cells will be flat and the product will not cushion as effectively. By limiting the flow of air to the material on the roll, the nip roller not only prevents the material backfilling and unwinding when the roll is sitting idle on the machine, it also facilitates the inflation of longer rows of cells and thus permits wider rolls of material to be used. The nip also provides rolling resistance and prevents loss of control of the roll.

It is apparent from the foregoing that a new and improved machine for inflating and sealing preconfigured film materials to make an air-filled cushioning material has been provided. While only certain presently preferred embodiments have been described in detail, as will be apparent to those familiar with the art, certain changes and modifications can be made without departing from the scope of the invention as defined by the following claims.

The invention claimed is:

1. A machine for inflating and sealing a preconfigured cushioning material which is wound in a roll on a hollow cylindrical core and has superposed layers of plastic film sealed together to form rows of interconnected, inflatable cells, a longitudinally extending inflation channel near one edge of the material and inlet passageways interconnecting the inflation channel and the rows of cells, comprising: a rotatively mounted roll support shaft having a fixed end and a free end, a hub mounted on the shaft near the fixed end for engagement with the core at the end of the roll near the inflation channel, a circumferentially expandable roll gripper at the free end of the shaft for locking engagement with the inner wall of the cylindrical core, means for drawing the material from the roll and feeding it along a predetermined path, an inflator having a conically tapered tip and a plurality of outlet openings adapted to be received in the inflation channel for injecting air into the cells as the material travels along the path, a nip roller, means for pressing the nip roller against the roll of film material to block the inflation channel and thereby limit the flow of air into the material on the roll and to provide rolling resistance to rotation of the roll, and means for sealing the inlet passageways to retain the air in the cells.

2. The machine of claim 1 wherein the roll gripper includes a body with an axially inclined surface, a jaw in sliding engagement with the inclined surface, and a screw operable from the fixed end of the shaft for advancing the jaw along the inclined surface to drive the jaw in an outward direction toward the inner wall of the core.

3. The machine of claim 2 wherein the body of the roll gripper is affixed to the free end of the shaft, and the screw is threadedly connected to the jaw for drawing the jaw and the body together.

4. The machine of claim 1 wherein the inflator includes a hollow base and a plurality of wire-like elements extending between the base and the conically tapered tip, with the openings being formed between the wire-like elements.

5. The machine of claim 1 wherein the inflator has an elongated tubular body, with the conically tapered tip being mounted at one end of the tubular body, and the outlet openings being formed as elongated slots in the side wall of the tubular body.

6. The machine of claim 1 including a knife blade mounted on the inflator for slitting the film along the inflation channel when the cells are inflated.

7. The machine of claim 1 wherein the nip roller is mounted on a swing arm and pressed against the roll of film material by a spring.

8. A machine for inflating and sealing a preconfigured cushioning material which is wound in a roll on a hollow cylindrical core and has superposed layers of plastic film sealed together to form inflatable cells, comprising: a rotatively mounted roll support shaft having a fixed end and a free end, a hub mounted on the shaft near the fixed end for engagement with the core at one end of the roll, a circumferentially expandable roll gripper at the free end of the shaft for locking engagement with the inner wall of the cylindrical core, means for drawing the material from the roll and feeding the material along a predetermined path, an inflator for injecting air into the cells as the material travels along the path, and means for sealing the cells to retain the air therein.

9. The machine of claim 8 wherein the roll gripper includes a body with a plurality of axially inclined surfaces affixed to the shaft, a plurality of jaws in sliding engagement with the inclined surfaces, and a screw operable from the fixed end of the shaft for drawing the jaws and the body together to advance the jaws along the inclined surfaces and thereby drive the jaws in an outward direction.

10. The machine of claim 9 wherein the screw extends coaxially within the shaft and projects from the fixed end, with a manually operable knob affixed to the projecting portion of the screw.

11. The machine of claim 8 wherein the roll gripper includes a body with a plurality of axially inclined surfaces affixed to the shaft, an adjustable head having a base spaced axially from the body and a plurality of circumferentially spaced jaws extending from the base toward the inclined surfaces, a screw threadedly engaged with the base extending through the shaft for drawing the head toward the body to advance the jaws along the inclined surfaces and drive the jaws in an outward direction toward the core, and an operating knob affixed to the screw adjacent to the fixed end of the shaft.

12. The machine of claim 8 wherein the portion of shaft near the fixed end extends through a support plate and is rotatively supported in a bearing mounted to the support plate on the opposite side of the plate from the hub.

13. A machine for inflating and sealing a preconfigured cushioning material having superposed layers of plastic film sealed together to form inflatable cells and a longitudinally extending inflation channel communicating with the cells, comprising:

means for feeding the material along a predetermined path;

an axially elongated inflation tube connected to a source of air with a free end adapted to be received in the inflation channel as the material travels along the path, a plurality of axially elongated slotted openings in the side wall of the inflation tube through which air can flow to inflate the cells, and a conically tapered tip mounted on the free end of the inflation tube; and means for sealing the cells to retain the air in therein.

14. The machine of claim 13 including a knife blade mounted on the inflation tube for slitting the film material along the inflation channel when the cells are inflated.

15. A machine for inflating and sealing a preconfigured cushioning material having superposed layers of plastic film sealed together to form inflatable cells and a longitudinally extending inflation channel communicating with the cells, comprising:

means for feeding the material along a predetermined path;

an inflator having an axially extending tubular base connected to a source of air for inflating the cells, a conically tapered tip spaced axially from the base, and a plurality of circumferentially spaced, wire-like elements extending between the base and the tip, with the tip, the wire-like elements and the base being adapted to be received in the inflation channel as the material is drawn along the path; and means for sealing the cells to retain the air therein.

16. The machine of claim 15 wherein the wire-like elements extend from the base toward the tip in a radially convergent manner.

17. The machine of claim 15 including a knife blade mounted on the base of the inflator for slitting the film material along the inflation channel when the cells are inflated.

18. A machine for inflating and sealing a preconfigured cushioning material which is wound in a roll and has superposed layers of plastic film sealed together to form inflatable cells and a longitudinally extending inflation channel communicating with the cells, comprising: means for rotatively supporting the roll of film material, means for drawing the material from the roll and feeding it along a predetermined path, an inflator for injecting air into the inflation channel to inflate the cells as the material travels along the path, a nip roller, means for pressing the nip roller against the roll of film material to block the inflation channel and thereby limit the flow of air into the material on the roll, and means for sealing the cells to retain the air therein.

19. The machine of claim 18 wherein the nip roller is positioned to engage an edge portion of the film material.

20. The machine of claim 18 wherein the nip roller is mounted on a swing arm and pressed against the roll of material by a spring.

21. The machine of claim 18 wherein the means for rotatively supporting the roll of film material includes a roll supporting shaft, and the nip roller is mounted on a swing arm which is rotatively mounted on a second shaft that is spaced from and generally parallel to the roll supporting shaft, with the means for pressing the nip roller against the roll of film material comprising a torsion spring disposed coaxially of the second shaft and in driving engagement with the swing arm.

22. The machine of claim 21 wherein the torsion spring is constrained between the swing arm and a stop affixed to the second shaft.

23. A machine for inflating and sealing a preconfigured cushioning material which is wound in a roll and has superposed layers of plastic film sealed together to form inflatable cells and a longitudinally extending inflation channel communicating with the cells, comprising: means for rotatively supporting the roll of film material, means for drawing the material from the roll and feeding it along a predetermined path, an inflator for injecting air into the inflation channel to inflate the cells as the material travels along the path, a nip roller fabricated of a relatively soft resilient material, means for pressing the nip roller against the roll of film material so that the nip roller is deformed by the roll, and a brake roller engagable with the nip roller to resist rotation of the nip roller.

24. The machine of claim 23 wherein the nip roller is mounted on a swing arm and pressed against the roll of material by a spring.

* * * * *